US009290960B1

(12) United States Patent
McHale

(10) Patent No.: US 9,290,960 B1
(45) Date of Patent: Mar. 22, 2016

(54) BURIAL CONCEPTS STACKING SYSTEM

(71) Applicant: Richard McHale, Dunmore, PA (US)

(72) Inventor: Richard McHale, Dunmore, PA (US)

( * ) Notice: Subject to any disclaimer, the term of this patent is extended or adjusted under 35 U.S.C. 154(b) by 77 days.

(21) Appl. No.: 14/293,429

(22) Filed: Jun. 2, 2014

(51) Int. Cl.
*E04H 13/00* (2006.01)
*A61G 99/00* (2006.01)
*A61G 17/08* (2006.01)

(52) U.S. Cl.
CPC ..... *E04H 13/003* (2013.01); *A61G 17/08* (2013.01); *A61G 99/00* (2013.01); *E04H 13/00* (2013.01); *E04H 13/006* (2013.01); *E04H 13/008* (2013.01)

(58) Field of Classification Search
CPC ..... E04H 13/008; E04H 13/00; E04H 13/006; E04H 13/003; A61G 17/08; A61G 99/00
USPC ..... 52/136, 133, 103, 128, 137; 27/1; 220/23.83, 23.88, 4.27; D99/17; 40/124.5
See application file for complete search history.

(56) References Cited

U.S. PATENT DOCUMENTS 3,529,730 A 9/1970 Thompson
3,581,452 A * 6/1971 Jalbert ..... 52/133
3,726,052 A * 4/1973 Thompson ..... 52/103
3,898,718 A * 8/1975 Eubank ..... 27/35
3,940,894 A * 3/1976 Nunes ..... 52/129
4,977,652 A * 12/1990 Graham ..... 27/1
5,815,897 A * 10/1998 Longstreth ..... 27/1
6,055,793 A * 5/2000 Irwin et al. ..... 53/436
6,279,212 B1 * 8/2001 Balch ..... 27/1
6,324,737 B1 * 12/2001 Chamness et al. ..... 27/2
6,421,890 B1 * 7/2002 Biggar ..... 27/1
6,493,911 B1 * 12/2002 Troin et al. ..... 27/1
6,520,606 B1 2/2003 Robinson
6,904,721 B1 * 6/2005 Forbes ..... 52/103
7,036,195 B2 * 5/2006 Glass ..... 27/1
7,191,498 B2 * 3/2007 Fischer ..... 27/1
7,478,461 B2 * 1/2009 Glass ..... 27/1
7,631,404 B2 * 12/2009 Scruggs ..... 27/35
7,703,185 B2 * 4/2010 Trail ..... 27/1
7,937,814 B2 * 5/2011 Voit ..... 27/1
8,209,918 B1 * 7/2012 Voit ..... 52/133
8,490,258 B1 * 7/2013 Muthusami ..... 27/1
8,966,725 B2 * 3/2015 Langelier ..... 27/1
2008/0229679 A1 * 9/2008 Trail ..... E04H 13/008 52/103

* cited by examiner

*Primary Examiner* — Robert Canfield
*Assistant Examiner* — Matthew Gitlin
(74) *Attorney, Agent, or Firm* — RG Patent Consulting, LLC; Rachel Gilboy

(57) ABSTRACT

A combination cremation/burial system that is specially designed to allow multiple burials on small, single plots of land. Design intent is to provide a unique means in which families can be interned together while saving both space and money.

11 Claims, 5 Drawing Sheets

BURIAL CONCEPTS STACKING SYSTEM

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

The following includes information that may be useful in understanding the present invention(s). It is not an admission that any of the information provided herein is prior art, or material, to the presently described or claimed inventions, or that any publication or document that is specifically or implicitly referenced is prior art.

BACKGROUND OF THE INVENTION

1. Field of the Invention

The present invention relates generally to the field of burial means and more specifically relates to a burial concepts stacking system.

2. Description of the Related Art

However unfortunate or ironic as it may seem, a guarantee of death is the one thing in life that all people hold in common. Whether a result of a long-term illness or a sudden and unexpected passing caused by an accident, death eventually will find us all. The most typical reaction to the death of a loved one is to celebrate and honor the life of the departed, via a wake or a funeral. Allowing family members to gather, friends to reminisce and providing an outlet for people to express their love and fond memories of the departed, funerals and memorial services offer a sense of closure for those loved ones who are left behind.

Most often, the remains of the departed are dealt with according to individual or familial preference and are either buried or cremated. While burials probably always will be performed, more and more consumers are turning to cremation as a more affordable, practical and environmentally friendly alternative to interment. In fact, according to a recent article in American Funeral Director, the cremation rate in North America is at forty percent and growing, with the United States projected to reach 50 percent by 2018, and Canada 85 percent by 2015. Perhaps the primary reason for such growth is economic; when faced with spending just hundreds of dollars for cremation as opposed to tens of thousands for a traditional interment, the choice for millions of struggling families is obvious.

Additionally, with cemeteries running out of room and available land for burials becoming increasingly scarce, cremation seems an even more practical choice. Finding it difficult to secure large cemetery plots to ensure that families can all be together in their final resting place, some see cremation interment in mausoleums as a solution to this problem. Unfortunately, such an endeavor can be quite costly, with consumers losing any savings they may have enjoyed by choosing cremation in the first place. An efficient and cost-effective means for burial is desirable.

Various attempts have been made to solve the above-mentioned problems such as those found in U.S. Pat. No. 4,977,652 to Gray Graham, U.S. Pat. No. 6,493,911 to Robert Troin et al, U.S. Pat. No. 6,520,606 to Hewitt Robinson, and U.S. Pat. No. 3,529,730 to Jence F. Thompson et al. This art is representative of burial means. None of the above inventions and patents, taken either singly or in combination, is seen to describe the invention as claimed.

Ideally, a burial concepts stacking system should provide efficiency in burial and, yet would operate reliably and be manufactured at a modest expense. Thus, a need exists for a reliable burial concepts stacking system to avoid the above-mentioned problems.

BRIEF SUMMARY OF THE INVENTION

In view of the foregoing disadvantages inherent in the known burial means art, the present invention provides a novel combination cremation/burial system that is specially designed to allow multiple burials on small, single plots of land. Design intent is to provide a unique means in which families can be interned together while saving both space and money. The general purpose of the present invention, which will be described subsequently in greater detail is to provide a burial concepts stacking system for efficiency in burial.

A burial concepts stacking system is disclosed herein comprising: a burial assembly including a grave marker, a base, at least one tubular member, and at least one cap; wherein the burial concepts stacking system comprises the burial assembly. The burial assembly comprises in functional combination the grave marker, the base, the at least one tubular member, and the at least one cap.

The grave marker visually indicates where a grave is located; wherein the grave marker preferably comprises a headstone (most preferably vertically placed atop the horizontally placed base). The headstone comprises indicia relative to identities of individuals as buried (either inscribed into the headstone as added or into a name plate(s)). The base comprises a mount for the headstone.

The base comprises a first receiver for receiving and holding a first tubular member and a second receiver for receiving and holding a second tubular member; wherein relationally-speaking the first receiver is located on a left portion of the base, and the second receiver is located on a right portion of the base. In these particular embodiments the headstone is located between the first receiver and the second receiver such that the first receiver and the second receiver can be accessed as necessary, and a balanced aesthetic look is created for functional display. The at least one cap preferably comprises a lock (suitable locking means) to prevent unauthorized removal thereof.

The at least one tubular member is vertically displaced downwardly (from the top of the base or the headstone depending on which particular embodiment) into the ground relative to the grave marker and is closed on an upper end via the at least one cap. Preferably each of the at least one tubular members comprises plastic tubing resistant to corrosion from an in-ground corrosive environment; each having a closed terminal end to limit downward travel of ash canisters stored therein such that they can be removed when desired. As such, the at least one tubular member is designed to hold in vertical series a plurality of the ash canisters; wherein each of plurality of the ash canisters comprises cremated remains of a single individual. The burial concepts stacking system provides a means for efficient burial of the individuals within a limited gravesite space.

A kit is described for use, manufacture and sale including: the grave marker, the tubular member(s), the cap(s), the base, and a set of user instructions. Faceplates, keys for cap locks and other kit contents may be included.

A method of using a burial concepts stacking system is also disclosed herein comprising the steps of: digging a first hole to a dimension suitable to accommodate a first tubular member, digging a second hole to a dimension suitable to accommodate a second tubular member, preparing a resting surface for a base (soil preparation as needed during the mentioned process to prevent settling), setting the base, inserting the first tubular member through the base into the first hole, inserting the second tubular member through the base into the second hole, mounting a grave marker to the base, placing at least one ash canister into the first tubular member in an internment, capping the first tubular member and the second tubular member, and locking the first tubular member and the second tubular member until authorized access is required. The method may further comprise the step(s) of adding in series and removing from in series the ash canister(s) as necessary.

The present invention holds significant improvements and serves as a burial concepts stacking system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, burial concepts stacking system, constructed and operative according to the teachings of the present invention.

The various embodiments of the present invention will hereinafter be described in conjunction with the appended drawings, wherein like designations denote like elements.

DETAILED DESCRIPTION

Figure 1:
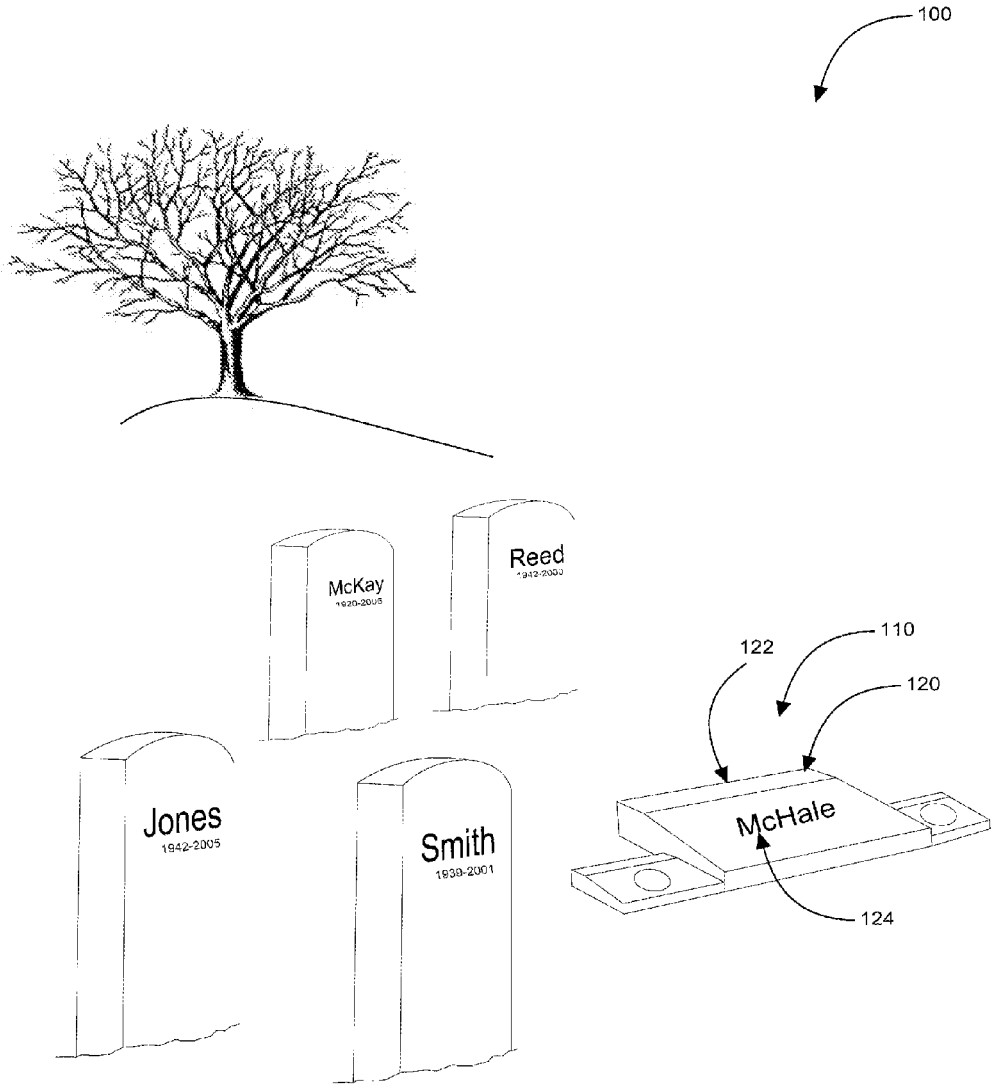
FIG. 1 shows a perspective view illustrating a burial concepts stacking system in an in-use condition according to an embodiment of the present invention.

As discussed above, embodiments of the present invention relate to a burial means and more particularly to a burial concepts stacking system as used to improve the efficiency of burial processes.

Generally speaking, the burial concepts stacking system comprises a combination cremation/burial system that is specially designed to allow multiple burials on small, single plots of land. The present invention facilitates full body interment in the traditional manner, while also permitting numerous, separate receptacles of 'cremains' to be interned in the same spot. This stacking system may be integrated into the plot, directly beneath the base of a headstone. A section of durable, heavy duty schedule-80 PVC (polyvinylchloride) pipe, measuring approximately up to six feet (6') in length and eight inches (8") in diameter may be inserted into the ground beneath the headstone. Yet, this pipe's sizing may be customized based on the need of the purchasing consumer.

At the top of the monument base, the stacking pipe may be covered by a granite or bronze plate, which may only be accessible by cemetery personnel. As designed, the burial concepts stacking system may, based on a two-person family plot, allow for up to fourteen (14) family burials per double lot purchase. Thus, this may include two (2) traditional burials with twelve (12) stacked cremation urns. Adaptable to both upright and in-ground headstones, the versatile burial concepts stacking system may also prove an ideal method for backyard interment in areas that allow the method.

The burial concepts stacking system interment method may handily ensure that all family members are kept together at burial. A novel combination of traditional full body burial and burial of cremation urns, the burial concepts stacking system may provide a simple and practical means of saving money as well as land space. As more and more are selecting the option of cremation in their funeral planning, this concept may fully embrace this choice by providing the way in which multiple members of one family can always be together, in one centralized location.

Additionally, the thousands of dollars that may be saved by utilizing the burial concepts stacking system is sure to be appreciated by all. At the same time, funeral businesses may be better able to sell clients on the idea of traditional burial if they are able to offer the option of multiple cremation interment to accompany it, thus increasing their bottom line. Cemeteries may also find the burial concepts stacking system to be a lucrative option to offer, as they may be able to free much more land space to sell. Both funeral and cemetery interests may certainly benefit over time, guaranteed family business for generations to come. The inventor has also suggested that the burial concepts stacking system may be expanded to accommodate pet cemeteries, providing conscientious pet owners with a way to celebrate the lives of the many pets that come into their lives.

The burial concepts stacking system is an innovative product invention that may conceivably revolutionize the funeral industry. Environmentally friendly by freeing land space while also allowing for multiple interments, this system may prove extremely appealing the world over. A method of monetizing may be associated with the present invention.

Referring to the drawings by numerals of reference there is shown in FIGS. 1-4, various views of burial concepts stacking system 100 comprising: burial assembly 110 including grave marker 120, at least one tubular member 130 (at least first tubular member 132 and may comprise second tubular member 134 in certain embodiments shown), and at least one cap 140 (at least first cap 142 and may comprise second cap 144 in certain embodiments shown); wherein burial concepts stacking system 100 comprises burial assembly 110.

Burial assembly 110 comprises in functional combination grave marker 120, the at least one tubular member 130, and the at least one cap 140. Grave marker 120 visually indicates where a grave is located. The at least one tubular member 130 is vertically displaced downwardly into the ground relative to grave marker 120 and is closed on an upper end via the at least one cap 140. At least one tubular member 130 (first tubular member 132 and second tubular member 134) is designed to hold in vertical series a plurality of ash canisters 150, as shown. As such, burial concepts stacking system 100 provides a means for efficient burial of individuals within a limited gravesite space. Each of the plurality of ash canisters 150 comprises cremated remains of a single individual; wherein the single individual may comprise a human or a pet.

Figure 2:
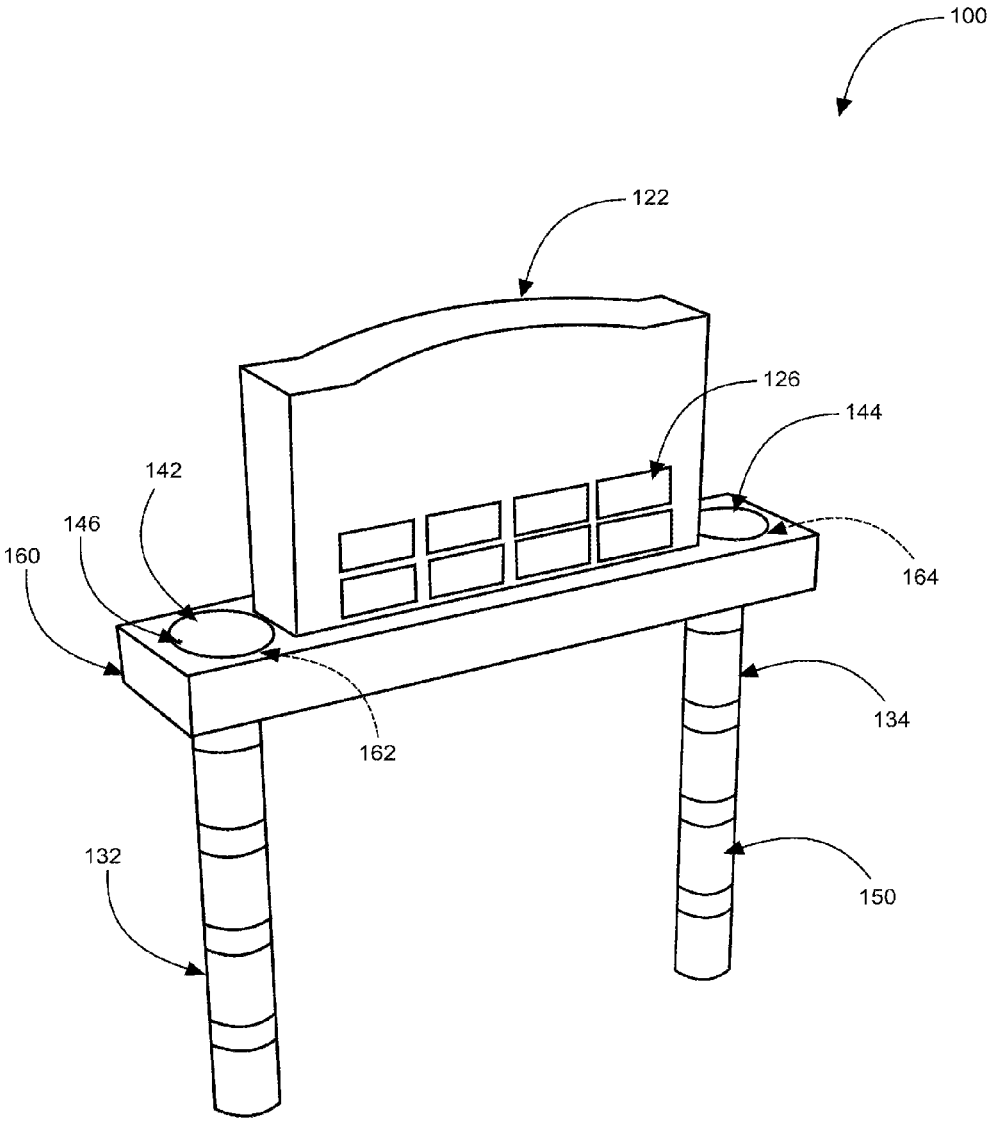
FIG. 2 is a perspective view illustrating a burial assembly of the burial concepts stacking system having a vertically mounted grave marker and base with two tubular members having ash canisters stored in series therein according to an embodiment of the present invention of FIG. 1.

Burial assembly 110 of burial concepts stacking system 100 may further comprise base 160, as shown in FIG. 2. Grave marker 120 may comprise headstone 122 or other suitable grave marking means. In preferred embodiments headstone 122 comprises indicia 124 relative to the individual(s) as buried. Alternately, headstone 122 comprises at least one nameplate 126 relative to the individual(s) as buried (preferably in order.) Base 160 comprises a mount for headstone 122. Base 160 comprises first receiver 162 for a first tubular member 132; base 160 may comprise second receiver 164 for second tubular member 134 (shown in FIG. 2).

In embodiments having first receiver 162 and second receiver 164; first receiver 162 is located on a left portion of base 160 and second receiver 164 is located on a right portion of base 160. The at least one cap 140 comprises lock 146 to prevent unauthorized removal thereof. Lock 146 may comprise any suitable locking means.

Figure 3:
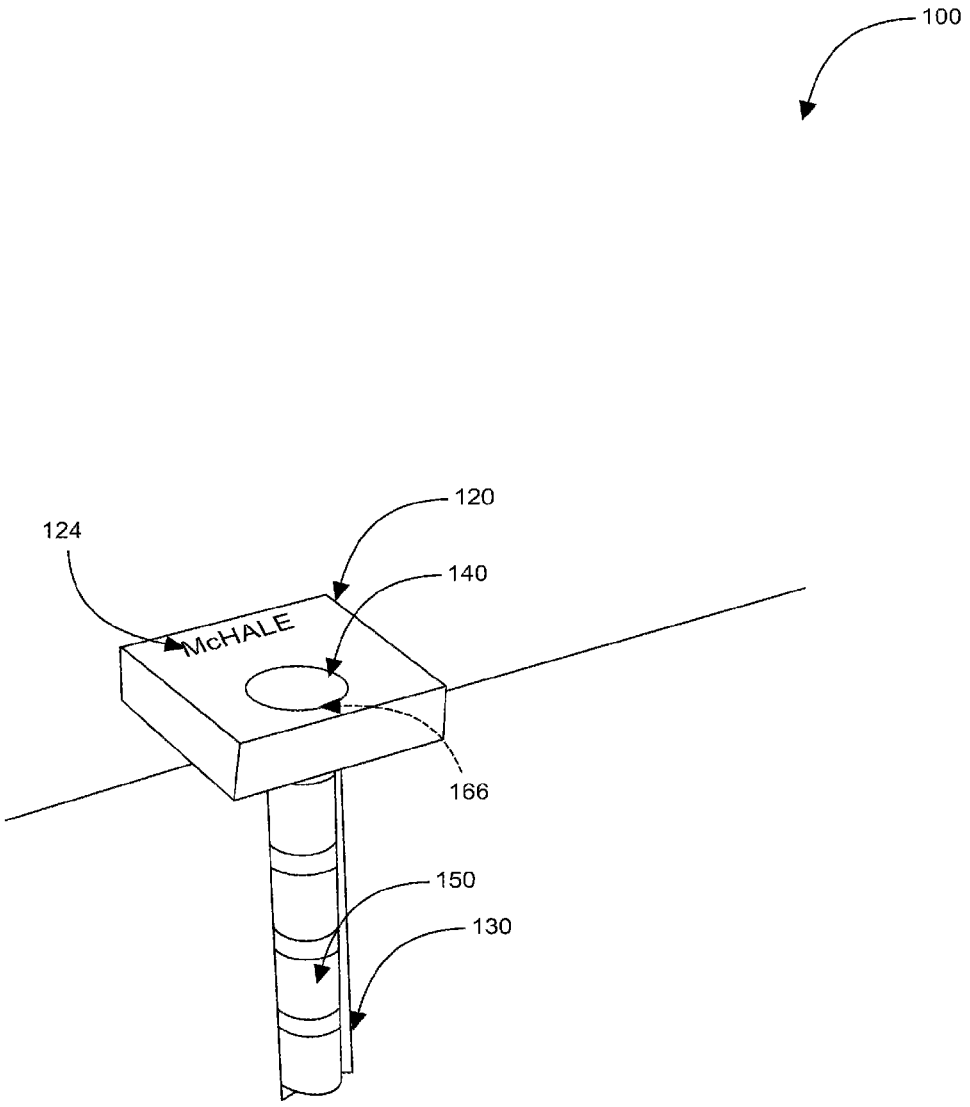
FIG. 3 is a perspective view illustrating a horizontally mounted grave marker and with a tubular member according to an embodiment of the present invention of FIG. 1.
Figure 4:
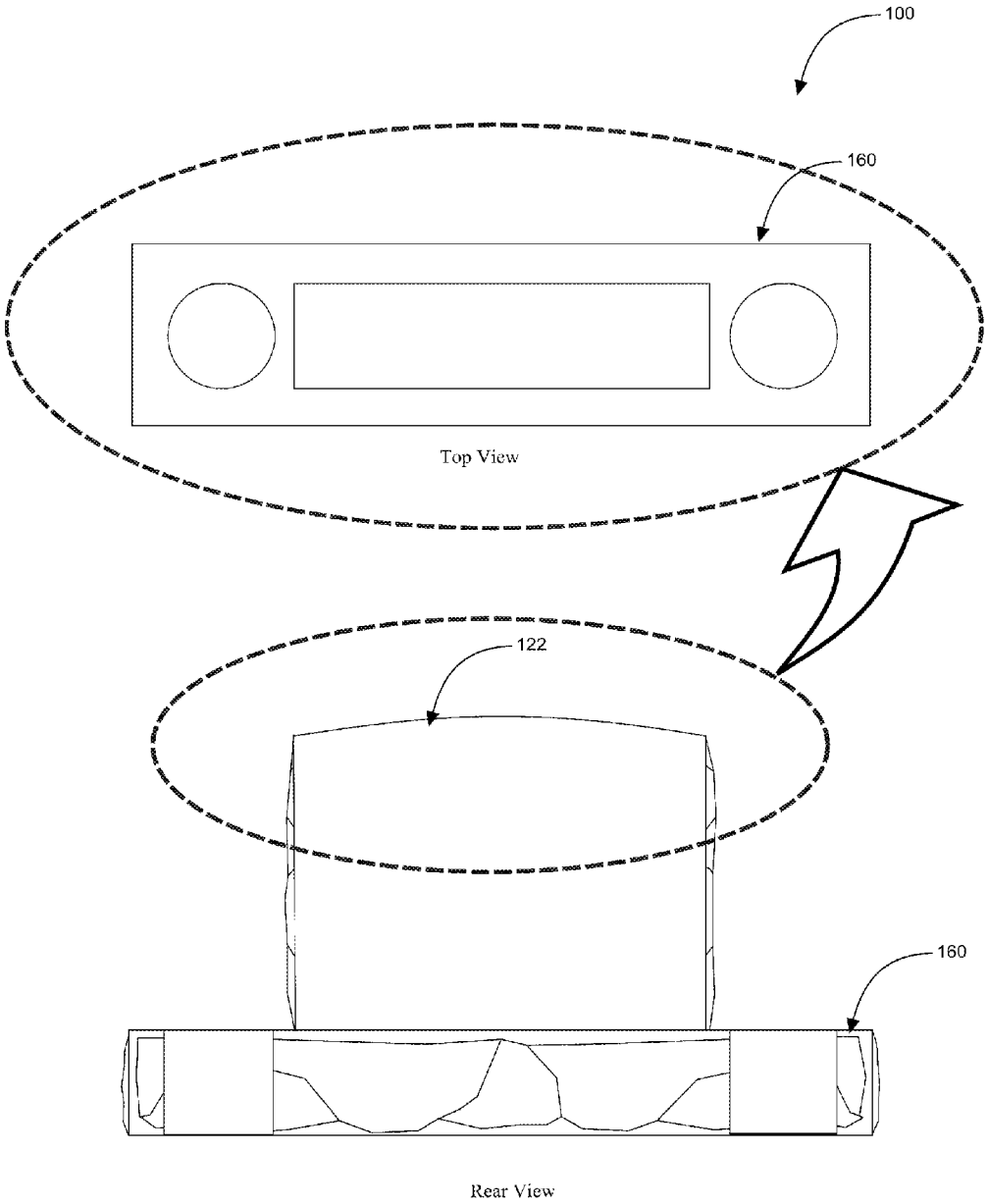
FIG. 4 is another perspective view illustrating the burial concepts stacking system according to an embodiment of the present invention of FIG. 1.

In embodiments as shown in FIG. 3, grave marker comprises a single through-hole 166 for receiving a single one of the tubular member(s) 130, and a singular cap 140 is used to enclose tubular member 130 from a top side for authorized access as needed. The present invention is able to be sealed and locked to sealingly enclose the plurality of ash canisters 150. In preferred embodiments each of the at least one tubular members 130 (first tubular member 132 and second tubular member 134) comprises plastic tubing resistant to corrosion from in-ground corrosive environment and each having a closed terminal end to limit downward travel of ash canisters 150.

Burial concepts stacking system 100 may be sold as a kit comprising the following parts: at least one grave marker 120; at least one tubular member 130; at least one cap 140; at least one base 160; and at least one set of user instructions. The kit has instructions such that functional relationships are detailed in relation to the structure of the invention (such that the invention can be used, maintained, or the like in a preferred manner). Burial concepts stacking system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient. Faceplates, keys for cap locks and other kit contents may be included.

Figure 5:
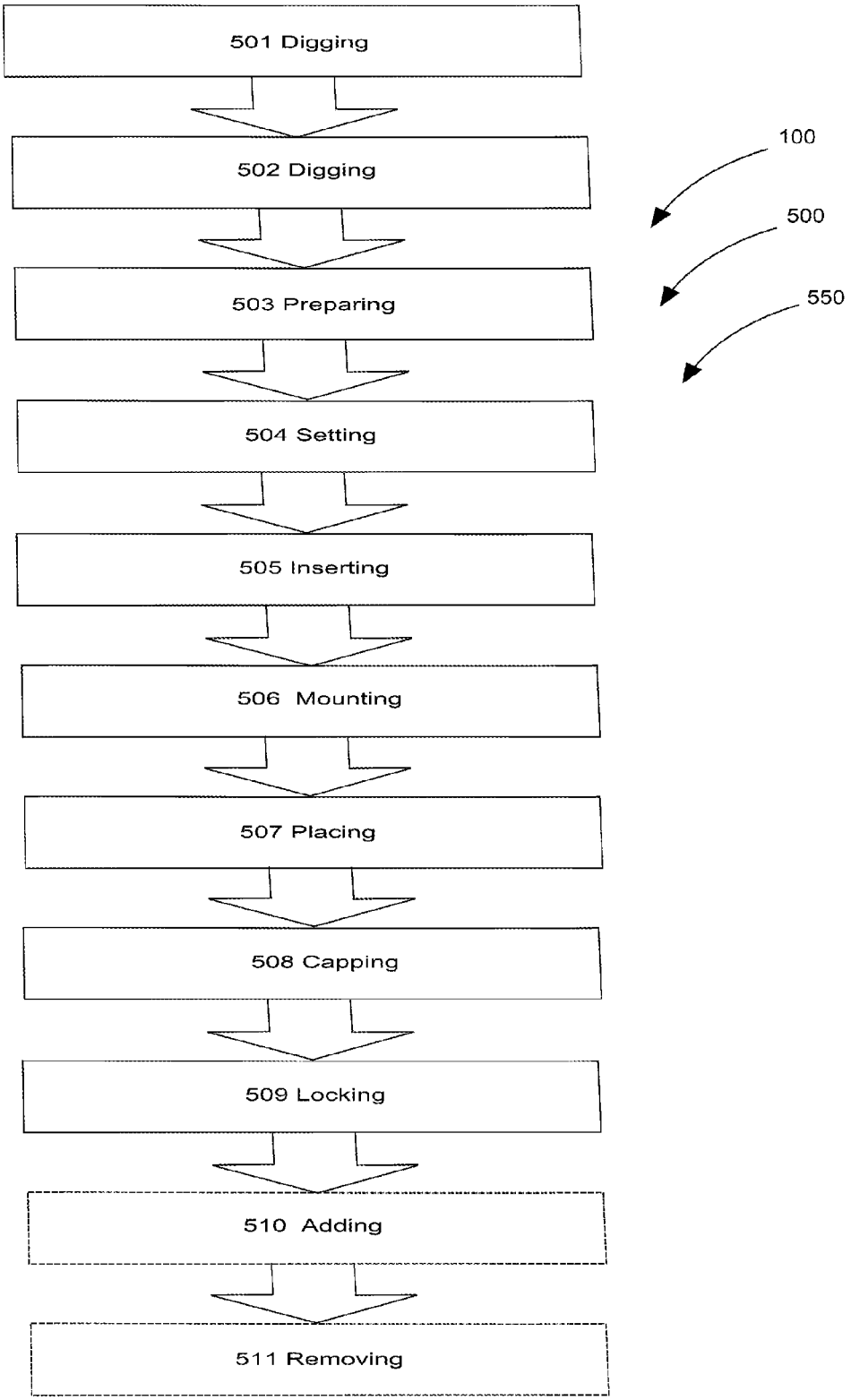
FIG. 5 is a flowchart illustrating a method of use for the burial concepts stacking system according to an embodiment of the present invention of FIGS. 1-4.

Referring now to FIG. 5, showing flowchart 550 illustrating a method of use 500 for burial concepts stacking system 100 according to an embodiment of the present invention of FIGS. 1-4.

A method of using (method of use 500) burial concepts stacking system 100 comprises the steps of: step one 501 digging a first hole to a dimension suitable to accommodate first tubular member 132, step two 502 digging a second hole to a dimension suitable to accommodate second tubular member 134, step three 503 preparing a resting surface for base 160 (soil preparation as needed during the mentioned process to prevent settling), step four 504 setting base 160, inserting first tubular member 132 through base 160 into the first hole, step five 505 inserting second tubular member 134 through base 160 into the second hole, step six 506 mounting grave marker 120 to base 160, step seven 507 placing at least one ash canisters 150 into first tubular member 132 in an interment, step eight 508 capping first tubular member 132 and second tubular member 134 via first cap 142 and second cap 144, and step nine 509 locking first tubular member 132 and second tubular member 134 until authorized access is required. The method 500 may further comprise the step(s) ten 510 of adding in series and step eleven 511 removing from in series ash canisters 150 as necessary.

It should be noted that step 510 and 511 are optional steps and may not be implemented in all cases. Optional steps of method 500 are illustrated using dotted lines in FIG. 5 so as to distinguish them from the other steps of method 500.

It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. A burial concepts stacking system comprising:

a) a burial assembly including;
   (1) a grave marker;
   (2) an elongated base;
   (3) a plurality of ash canisters;
   (4) two tubular members; and
   (5) two caps;

b) wherein said grave marker is structured and arranged to visually indicate where a grave is located;

c) wherein said two tubular members are structured and arranged to vertically displace downwardly into a ground surface relative to said grave marker and are further structured and arranged for closing on an upper end via said two caps;

d) wherein said two caps each comprises a lock structured and arranged to prevent unauthorized removal thereof;

e) wherein each of said two tubular members comprises plastic tubing resistant to corrosion from in-ground corrosive environment;

f) wherein said two tubular members are structured and arranged to vertically hold said plurality of ash canisters;

g) wherein each ash canister of said plurality of ash canisters is structured and arranged to hold the cremated ash remains of a single body;

h) wherein said burial assembly is structured and arranged to facilitate full body burial internment and further structured and arranged with said plurality of ash canisters to simultaneously intern said cremated ash remains of each of multiple bodies within one burial plot;

i) wherein said burial assembly is adapted to be structured and arranged within said burial plot such that said base is located directly above said full body burial internment and is located above said plurality of ash canisters to simultaneously intern said cremated ash remains of each of multiple bodies within one burial plot;

j) wherein said base comprises a first receiver for receiving a first of said two tubular members;

k) wherein said base comprises a second receiver for receiving a second of said two tubular members;

l) wherein said first receiver is located on a distal left portion of said base; and m) wherein said second receiver is located on a distal right portion of the base; and n) a headstone disposed on said base, wherein a distance between said first and second receivers is greater than a width of said headstone.

2. The burial concepts stacking system of claim 1 wherein each of said plurality of ash canisters comprises cremated remains of a single individual comprising a human.

3. The burial concepts stacking system of claim 1 wherein each of said plurality of ash canisters comprises cremated remains of a single individual comprising a pet.

4. The burial concepts stacking system of claim 1 wherein each of said two tubular members have a closed terminal end to limit downward travel of said plurality of ash canisters.

5. A burial concepts stacking system comprising:

a) a burial assembly including;

(1) a grave marker;

(2) an elongated base;

(3) a plurality of ash canisters;

(4) two tubular members;

(5) two caps; and (6) a headstone having an elongated horizontal cross-section substantially similar in shape to said elongated base, and having a height such that a front surface is provided for displaying burial information;

b) wherein said grave marker is structured and arranged to visually indicate where a grave is located;

c) wherein said two tubular members are structured and arranged to vertically displace downwardly into a ground surface relative to said grave marker and are further structured and arranged for closing on an upper end via said two caps;

d) wherein said two caps each comprises a lock structured and arranged to prevent unauthorized removal thereof;

e) wherein each of said two tubular members comprises plastic tubing resistant to corrosion from in-ground corrosive environment;

f) wherein said two tubular members are structured and arranged to vertically hold said plurality of ash canisters;

g) wherein each ash canister of said plurality of ash canisters is structured and arranged to hold the cremated ash remains of a single body;

h) wherein said burial assembly is structured and arranged to facilitate full body burial internment and further structured and arranged with said plurality of ash canisters to simultaneously intern said cremated ash remains of each of multiple bodies within one burial plot;

i) wherein said burial assembly is adapted to be structured and arranged within said burial plot such that said base is located directly above said full body burial internment and is located above said plurality of ash canisters to simultaneously intern said cremated ash remains of each of multiple bodies within one burial plot;

j) wherein said base comprises a first receiver for receiving a first of said two tubular members;

k) wherein said base comprises a second receiver for receiving a second of said two tubular members;

l) wherein said first receiver is located on a distal left portion of said base; and m) wherein said second receiver is located on a distal right portion of said base;

n) wherein said headstone is securely attached to said base between said first receiver and said second receiver; and o) wherein a distance between said first and second receivers is greater than a width of said headstone.

6. The burial concepts stacking system of claim 5 wherein said headstone includes indicia relative to said individuals as buried.

7. The burial concepts stacking system of claim 5 wherein said headstone includes at least one nameplate relative to said individuals as buried.

8. The burial concepts stacking system of claim 5 wherein said base comprises a mount for securely attaching said headstone.

9. The burial concepts stacking system of claim 5 wherein each of said plurality of ash canisters comprises cremated remains of a single individual comprising a human.

10. The burial concepts stacking system of claim 5 wherein each of said plurality of ash canisters comprises cremated remains of a single individual comprising a pet.

11. The burial concepts stacking system of claim 5 wherein each of said two tubular members have a closed terminal end to limit downward travel of said plurality of ash canisters.

* * * * *